United States Patent [19]

Hammerly et al.

[11] Patent Number: 5,004,441

[45] Date of Patent: Apr. 2, 1991

[54] MODEL ROCKET CAR

[76] Inventors: Jeffrey L. Hammerly, 420 NW. 49th St., Fort Lauderdale, Fla. 33309; David S. Rosenthal, 1225 Riverside Dr. #505, Coral Springs, Fla. 33071

[21] Appl. No.: 445,777

[22] Filed: Dec. 4, 1989

[51] Int. Cl.[5] ..... A63H 17/00

[52] U.S. Cl. ..... 446/211; 446/52; 446/435

[58] Field of Search ..... 446/211, 212, 186, 187, 446/430, 429, 180, 176, 56, 52, 53, 51, 435, 457; 273/86 R; 102/351, 348

[56] References Cited

U.S. PATENT DOCUMENTS

| | | | |
|---|---|---|---|
| 2,410,682 | 11/1946 | Richardson | 446/211 X |
| 3,292,302 | 12/1966 | Estes et al. | 446/212 |
| 3,740,896 | 6/1973 | Glass et al. | 446/212 |
| 3,787,013 | 1/1974 | McKenzie, Sr. | 446/52 X |
| 3,844,557 | 10/1974 | Pompetti | 446/51 X |
| 3,950,889 | 4/1976 | Dabney | 446/212 |
| 4,073,087 | 2/1978 | Ieda | 446/51 |

OTHER PUBLICATIONS

Estes Model Rocket Instructions, Estes Industries, Penrose, Colo. 81240.

*Primary Examiner*—Mickey Yu
*Attorney, Agent, or Firm*—Oltman and Flynn

[57] ABSTRACT

This model rocket car carries a U-shaped tube with lower and upper straight segments connected at their front ends by a bight segment. The lower segment of the tube holds a model rocket engine which, upon ignition, first ejects gas out the back end to propel the car forward and after a burning time ejects gas from its front end forward into the tube. The upper segment of the tube holds a folded braking parachute, tethered to the car, which is blown out of the tube by the gas ejected from the front end of the engine and opens behind the car. Flame retardant wadding is in the upper segment of the tube directly in front of the folded parachute.

4 Claims, 4 Drawing Sheets

END VIEW

END VIEW

MODEL ROCKET CAR

SUMMARY OF THE INVENTION

This invention relates to a model rocket car.

A principal object of this invention is to provide a novel model car carrying a model rocket engine which after ignition first propels the car forward and later ejects a braking parachute that brings the car to a stop.

Preferably, the invention has a generally U-shaped tube on the car with lower and upper straight segments connected at their front ends by a curved bight segment, a model rocket engine in the lower segment of the tube, and a folded parachute in the upper segment of the tube tethered to the car by a flexible line. The engine, which is of known design, first ejects gas out the back end of the lower segment of the tube to propel the car forward and, after a burning time ejects gas forward into the tube to blow the parachute out of the back end of the upper segment of the tube for braking the car to a stop.

Further objects and advantages of this invention will be apparent from the following detailed description of a presently preferred embodiment which is illustrated schematically in the accompanying drawings.

Before explaining the disclosed embodiment of the present invention in detail it is to be understood that the invention is not limited in its application to the details of the particular arrangement shown since the invention is capable of other embodiments. Also, the terminology used herein is for the purpose of description and not of limitation.

DETAILED DESCRIPTION

Figure 1:
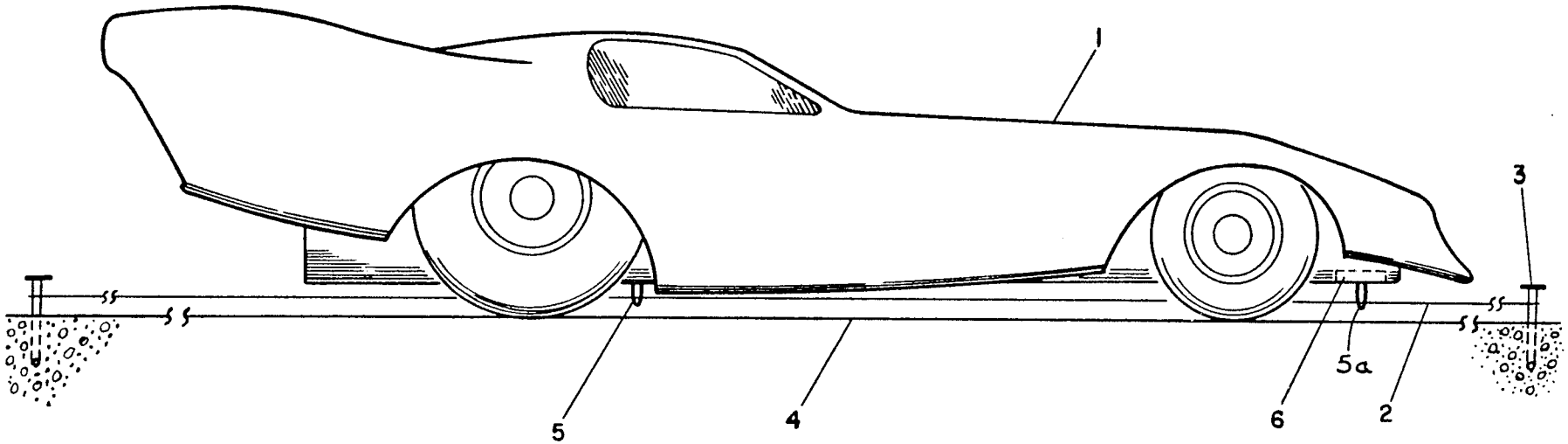
FIG. 1 is a side elevation of a model rocket car embodying the present invention.
Figure 6:
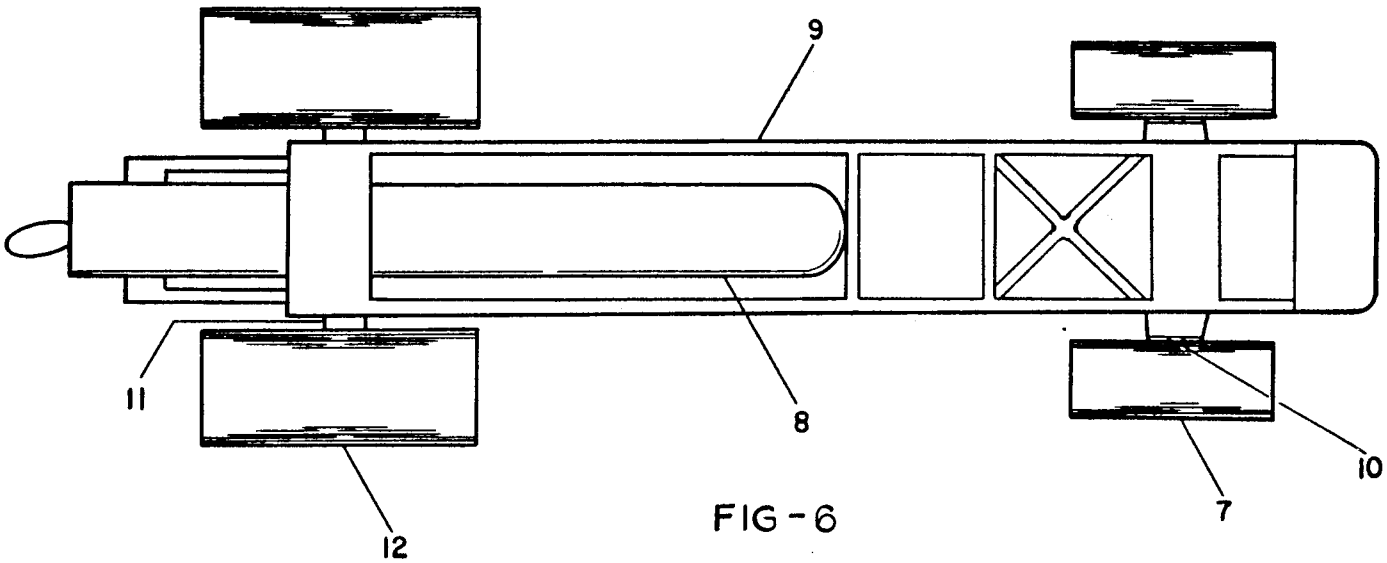
FIG. 6 is a top plan view of the car with its body removed, as in FIG. 2.
Figure 2:
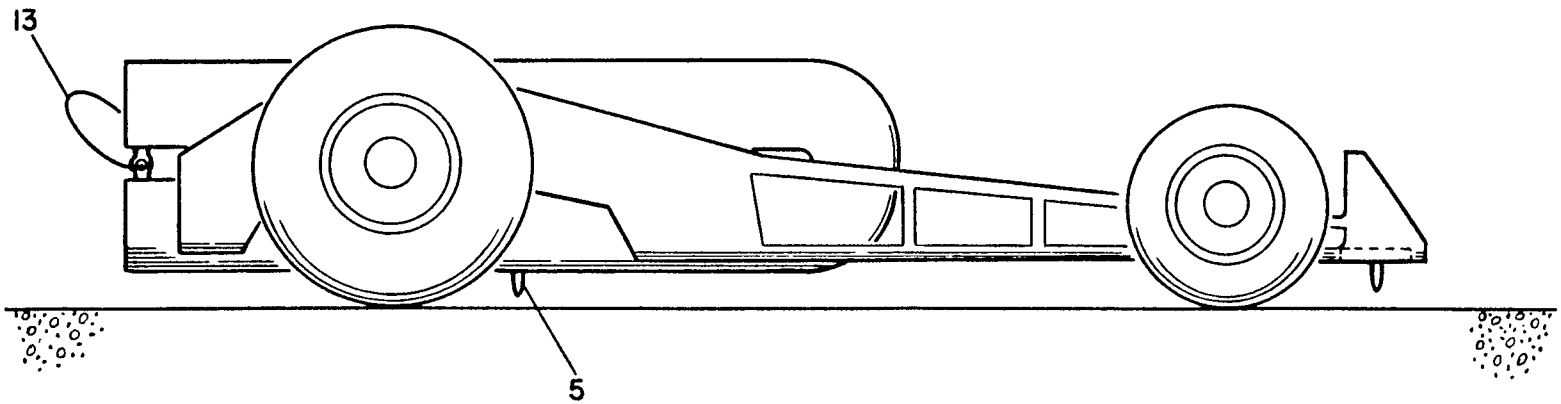
FIG. 2 is a side elevation of the car with its body removed.
Figure 5:
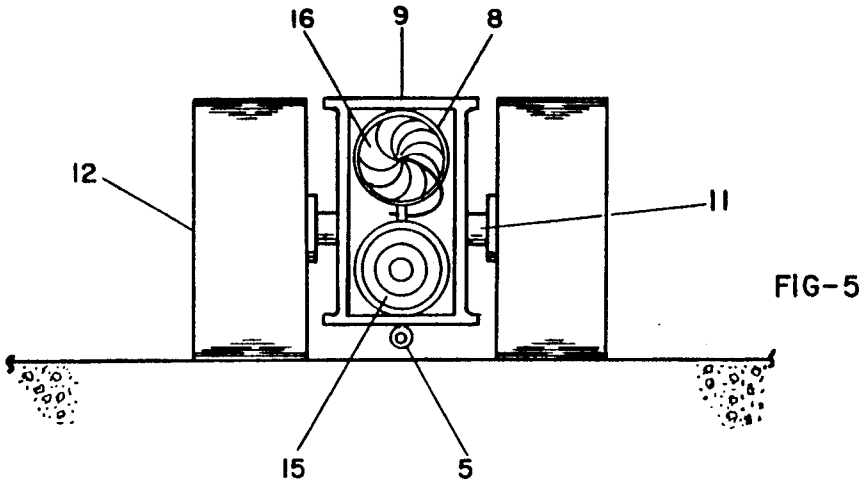
FIG. 5 is a rear elevation of this tube, taken along the line 5—5 in FIG. 3 behind the rear wheels of the car.

FIG. 1 shows a model rocket car 1 embodying the present invention, The car has a pair of front wheels 7 on a front axle 10 (FIG. 6) and rear wheels 12 on a rear axle 11 which engage a horizontal support surface 4, such as a concrete pavement. The car has downwardly projecting eyelets 5 and 5*a* in front of its rear and front wheels, respectively and midway across the car. These eyelets slidably receive a guide line or tether line 2 for the car. This guide line extends horizontally a short distance above the support surface 4 between a front stake 3 and a rear stake 3'. The chassis of the car is shown at 9 in FIGS. 2 and 6. It carries a front end counterweight 6 directly above the front eyelet 5*a* for guide line 2.

Figure 7:
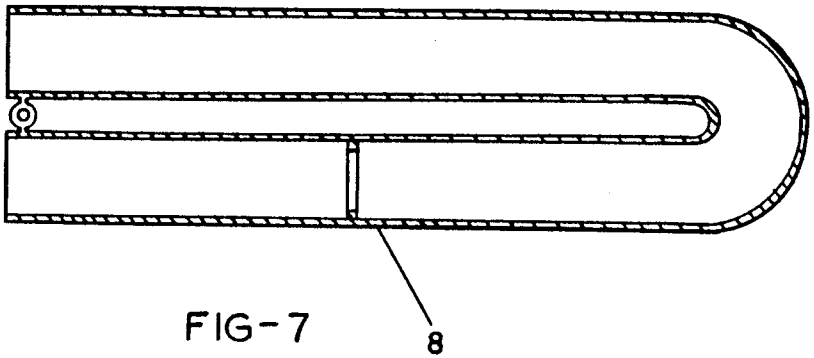
FIG. 7 is a view like FIG. 4 but with the engine and parachute removed from the tube.
Figure 8:
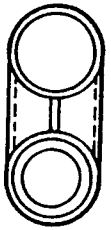
FIG. 8 is a rear elevation of the empty tube shown in FIG. 7.

In accordance with the present invention a U-shaped tube 8 (FIGS. 2 and 3) is rigidly mounted on the chassis 9 between the rear wheels 12. This tube has a straight lower segment 8*a* which is horizontally elongated longitudinally of the car, a similarly elongated straight upper segment 8*b*, and a reversely bent bight segment 8*c* connecting the upper and lower segments 8*a* and 8*b* at their front ends. The bight segment 8*c* of tube 8 is spaced in front of the rear wheels 12 slightly more than half-way toward the front wheels 7. The upper and lower segments 8*a* and 8*b* of the tube project rearwardly beyond the car chassis 9 behind the rear wheels 12. As shown in FIG. 7, the lower segment 8*a* of the tube has an opening 21 in its back end and the upper segment 8*b* has an opening 22 in its back end.

Figure 4:
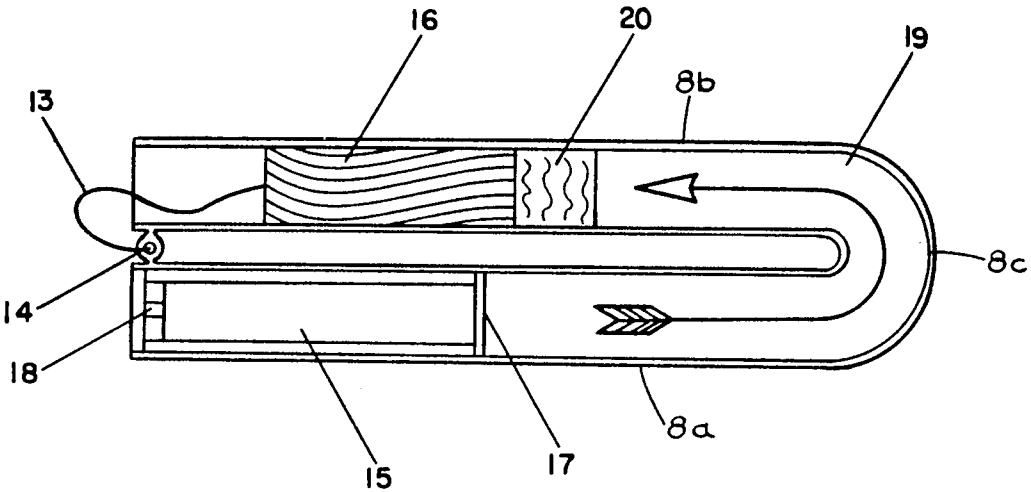
FIG. 4 is a fragmentary vertical section taken longitudinally of the car through the tube which holds a model rocket engine and the folded parachute.
Figure 9:
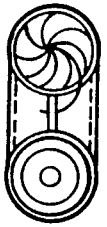
FIG. 9 is a rear elevation of the tube holding the engine and the folded parachute, as in FIG. 4.

As shown in FIG. 4, the lower segment 8*a* of tube 8 receives a model rocket engine 15 of known design whose front end engages a stop ring 17 on the inside of the tube. The rocket engine has a slightly protruding exhaust nozzle 18 at its back end which is removable with the rest of the engine and which is open toward the opening 21 in the back end of the lower segment 8*a* of tube 8. In one practical embodiment, the model rocket engine 15 is an "Estes Model Rocket Engine" sold by Estes Industries, Penrose, Colo. 81240. Any other suitable commercially available rocket engine can be used. It contains an ignitable charge which after ignition first discharges a "thrust charge" of gas rearwardly through its exhaust nozzle 18 and, after a few seconds burning time, discharges an "ejection charge" of gas ahead of its front end. This burning time is correlated with the distance along the guide line 2 for the car's travel between the rear and front stakes 3' and 3 in FIG. 1.

Figure 3:
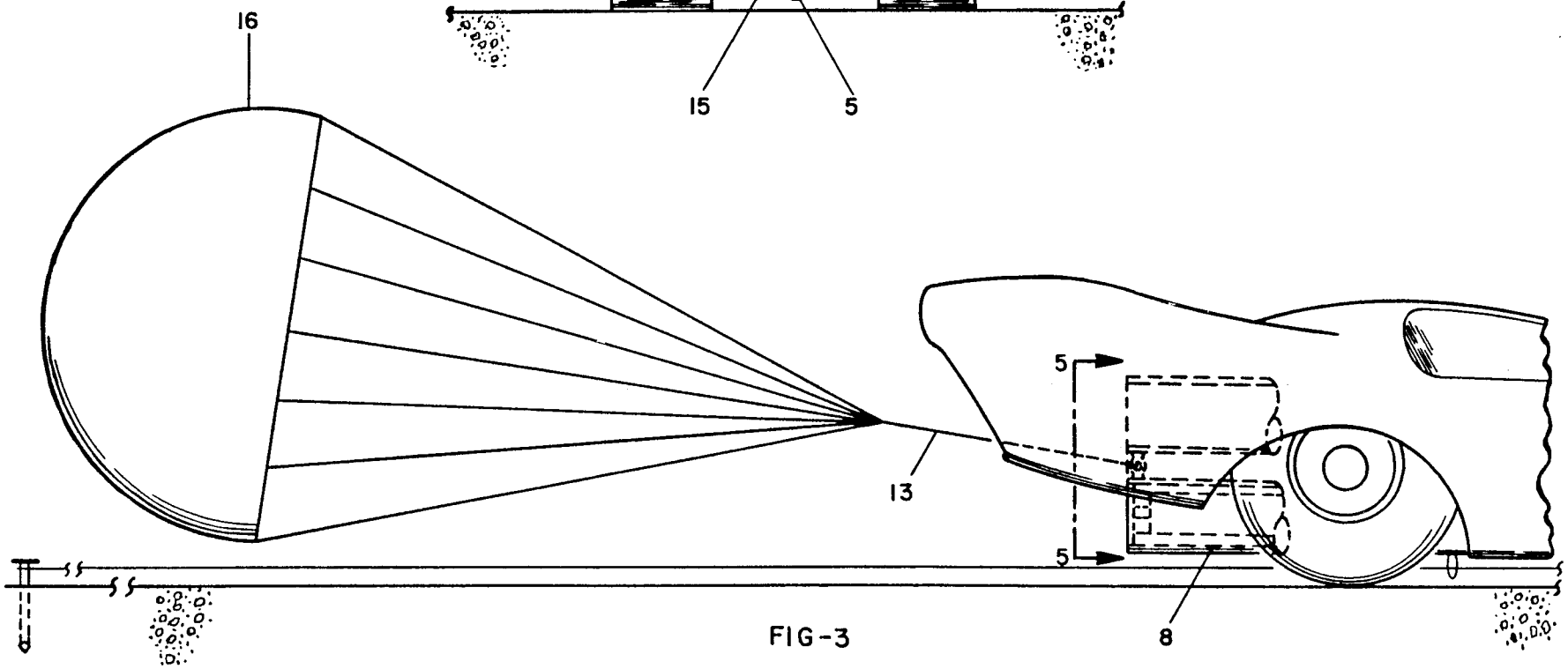
FIG. 3 is a side elevation of the rear part of the car after the parachute has been released and has opened to brake the car to a stop.

A folded miniature parachute 1 of known design (FIG. 4) is received in the upper segment 8*b* of tube 8 a short distance in front of the rear opening 22. A flexible line 13 extends between this parachute and an anchor eyelet 14 located between the upper and lower segments of the tube and rigidly attached to them near their back ends. A flame resistant wadding 20 is located inside the upper segment 8*b* of the tube directly in front of the folded parachute 16. The parachute is folded and inserted in the tube such that the pressure of an ejection charge of gas in front of it from the model rocket engine 15 will expel the parachute rearwardly through the opening 22 and will assist in the opening of the parachute as shown in FIG. 3.

In the operation of this apparatus, the car starts at a position close to the rear stake 3' in FIG. 1, with the eyelets 5 and 5*a* on the bottom of the car passing the guide line 2, and the model rocket engine 15 and the folded parachute 16 inside the tube 8 on the car, as shown in FIG. 4. (The front stake 3 is much farther away from the car than appears in FIG. 1, which shows a break in the guide line 2 between them).

The user ignites the model rocket engine 15 with a commercially available ignition system in the usual way. First, the engine produces a gas discharge (called a "thrust charge") rearwardly through its nozzle 18 and out through the back opening 21 in the lower segment 8*a* of tube 8 which propels the car across the support surface 4 away from the rear stake 3' and toward the front stake 3. After a burning time, the engine 15 produces a gas discharge (called an "ejection charge") at its front end which flows through the tube 8 along a U-shaped path until it reaches the folded parachute 16, at which time it blows the parachute rearwardly out through the back opening 22 in the upper segment **8*b* of the tube and assists in opening the parachute, as shown in FIG. 3, with the flex line 13 limiting how far behind the car the parachute can move. The open parachute acts as a brake, bringing the car to a stop before it reaches the front stake 3**.

We claim:

1. A model rocket car comprising:

a miniature vehicle having means for engagement with a support surface;

a "U"-shaped " tube on said vehicle having first and second rearwardly-facing openings and a reversely bent closed passageway between said openings;

a model rocket engine positioned in said tube in front of said first opening, said engine having an exhaust nozzle at its rear end which is open toward said first opening and means at its front end for discharging pressurized gas into said passageway, said engine having ignitable charge means therein for first discharging through said exhaust nozzle at its rear end to propel the car forward and after a burning time for discharging from its front end into said passageway in the tube;

a folded parachute positioned in said tube in front of said second opening to be blown rearward out of said tube and to open in response to the time-delayed discharge from said front end of the engine;

an externally disposed eyelet;

and a flex line connecting said parachute to said eyelet to limit the rearward movement of the parachute when blown out of said tube, whereby said parachute upon opening brakes the forward movement of the vehicle.

2. A model rocket car according to claim 1 wherein: said tube has a substantially straight lower segment which is elongated longitudinally of the miniature vehicle, a substantially straight upper segment above said lower segment, and a bight segment connecting said lower and upper segments at their respective front ends;

said first opening in said tube is at the back end of its lower segment;

said model rocket engine is in said lower segment of the tube;

said second opening in said tube is at the back end of its upper segment;

and said folded parachute is in said upper segment of said tube.

3. A model rocket car according to claim 2 and further comprising a flame retardant wadding in said upper segment of said tube in front of said folded parachute.

4. A model rocket car according to claim 1 and further comprising flame retardant material in said tube in front of said folded parachute.

* * * * *